United States Patent [19]

Mack et al.

[11] 4,228,913

[45] Oct. 21, 1980

[54] BEVERAGE CAN HAVING A SELF CONTAINED STRAW

[76] Inventors: Alberto Mack; Charing Mack, both of 32 Harmony St., Piscataway, N.J. 08854

[21] Appl. No.: 32,109

[22] Filed: Apr. 19, 1979

[51] Int. Cl.[2] ..... A47G 19/22

[52] U.S. Cl. ..... 220/90.2; 229/7 S; 215/1 A

[58] Field of Search ..... 220/90.2, 90.4, 90.6; 215/1 A; 229/7 S

[56] References Cited

U.S. PATENT DOCUMENTS

| | | | |
|---|---|---|---|
| 3,303,985 | 2/1967 | Poukes | 229/7 S |
| 3,406,868 | 10/1968 | Rogers | 220/90.2 |
| 3,656,654 | 4/1972 | Brinkley | 215/1 A |
| 3,776,458 | 12/1973 | Charga | 229/7 S |
| 4,109,817 | 8/1978 | Payne | 229/7 S |

*Primary Examiner*—George E. Lowrance

*Attorney, Agent, or Firm*—Thomas W. Cole; James R. Laramie

[57] ABSTRACT

The invention relates to a tab top can having a self contained drinking straw. The straw includes a resilient bellows structure on its bottom which serves to bias the top end of the straw against the underside of the tab top. A straw guide secured on the interior of the can aligns the top end of the straw with the underside of the tab top. The bellows structure forces the top end of the straw through the drinking slot formed when the tab top is removed from the can.

3 Claims, 3 Drawing Figures

BEVERAGE CAN HAVING A SELF CONTAINED STRAW

BACKGROUND OF THE INVENTION

1. Field of the Invention

This invention relates to a tab top can having a self contained drinking straw.

2. Description of the Prior Art

The tab top beverage can has done much in recent years to encourage the consuming public to drink directly from the beverage can itself, rather than through the intermediary of a glass or mug or other type of reusable drinking utensil. Such cans are easily manually opened without the use of special appliances, and afford a ready made, disposable drinking utensil.

However, while such cans serve their function well as beverage containers, they often fail to provide a completely sanitary drinking utensil due to the fact that dust and dirt often accumulate on the top lid of such cans around the areas where the lips draw the liquid from the can. Additionally, most of such can lids are circumscribed by a dirt collecting, annular groove which is formed incidental to the manufacture of the flange structure which is used to sealingly engage such lids around the upper edge of the cylindrical body of the can. This annular groove forms a natural depository for dirt, dust and other deleterious matter which settles onto the top of the can prior to use. Worse still, small amounts of the beverage are captured by this groove when a consumer first begins to drink from the can, which in turn flows around the groove and collects the dirt and grime contained therein. This dirt entrained beverage then deposits this dirt and grime into the mouth of the consumer whenever he subsequently tips the can to his lips.

Thus, a need has arisen for a simple, inexpensive and convenient way to draw the beverage from a tab top beverage can in a sanitary fashion. Prior to the present invention, no solutions to this problem were known which did not substantially impair the convenience factor so critically important in the use of such cans. The invention hereafter described provides a perfectly sanitary and convenient solution to the problem.

SUMMARY OF THE INVENTION

The invention relates to a tab top beverage can having a self contained drinking straw. A straw guide aligns the top end of the straw against the underside of the tab top assembly. The straw guide also secures the straw within the can so that the top end of the straw will not move around within the can and lose its alignment with the underside of the tab top assembly. The straw has an integrally formed, resilient bellows structure for biasing the top end of the straw against the underside of the tab top, so that the top end of the straw is ejected through the drinking slot formed when the tab top assembly is pulled off. The invention is called a "sip can".

BRIEF DESCRIPTION OF THE DRAWINGS

Finally.

DETAILED DESCRIPTION OF THE PREFERRED EMBODIMENT

Figure 1:
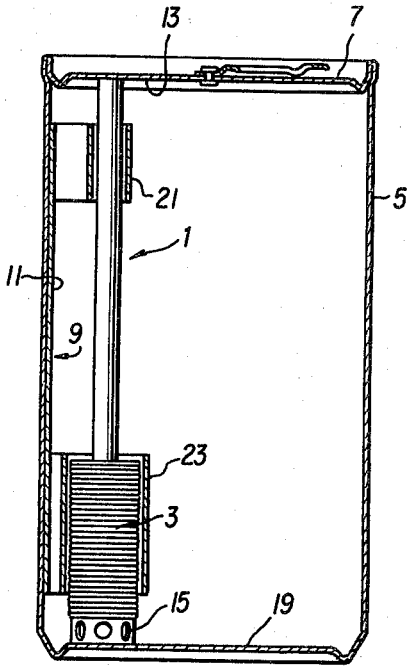
FIG. 1 illustrates a cross sectional view of the preferred embodiment before the tab top assembly is removed.
Figure 2:
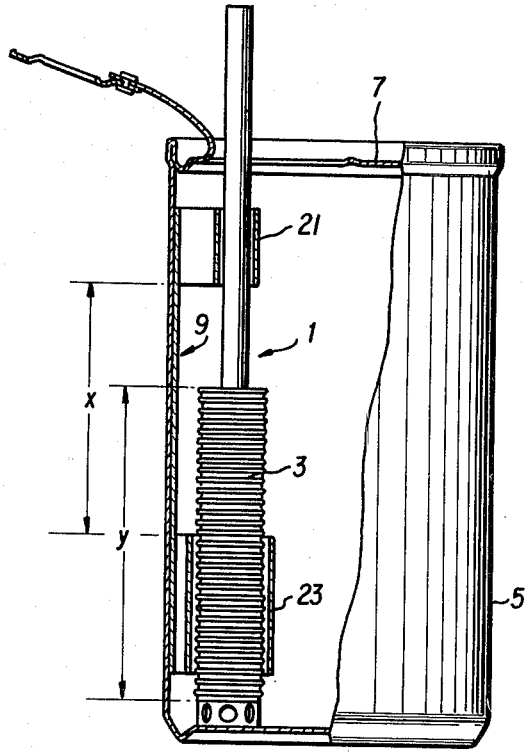
FIG. 2 illustrates a cross sectional view of the preferred embodiment after the tab top is removed and the top end of the straw is ejected through the drinking slot.

As illustrated in FIGS. 1 and 2, a drinking straw 1 having a resilient bellows structure 3 at its bottom end is inserted within a drinking can 5 at some time prior to the time can top 7 is sealingly secured onto the top edge of the cylindrical body of the can 5 after being filled with a beverage. A straw guide 9 is fastened onto the inner side wall 11 of the can 5 by tack welding, gluing or the like. Straw guide 9 may be inexpensively formed from coated sheet metal, plastic, or any other easily fabricated material which would be inert to the liquid contents of the can 5.

Pursuant to the manufacturing process of can 5, can top 7 is pressed down and secured onto the top edge of can 5 with the underside of tab top assembly 13 in alignment with the top end of straw 1. The act of securing can top 7 onto can 5 compresses the resilient bellows structure 3 at the bottom of staw 1 into the position illustrated in FIGS. 1 and 2, which in turn biases the top of straw 1 against the underside of tab top assembly 13 of can top 7.

When tab top assembly 13 is manually removed by the consumer, the compressed bellows 3 expands, forcibly ejecting the top end of straw 1 through the drinking slot formed by the removal of tab top assembly 13. Straw 1 then assumes the position illustrated in FIG. 2.

Drinking straw 1 may include one or more flow path openings 15 at the bottom extremity of straw 1 in order to insure that a fluid flow path is always open between the bottom of straw 1 and the liquid beverage inside of can 5. These flow paths insure that the straw 1 and the liquid contents of can 5 remain in fluid communication even if the suction caused by the consumer in sucking the beverage through the straw should draw the bottom of bellows 3 against the bottom 19 of can 5. It should be noted that even though flow paths 15 are illustrated as perforations in FIGS. 1 and 2, such flow paths may be formed by serrating the bottom edge of bellows 3 or by any number of alternative ways.

Although such flow paths are preferred, they are not strictly necessary to the functioning of the invention, since the straw 1 is linearly movable along the longitudinal axis of straw guide 9 as will be hereafter described.

Figure 3:
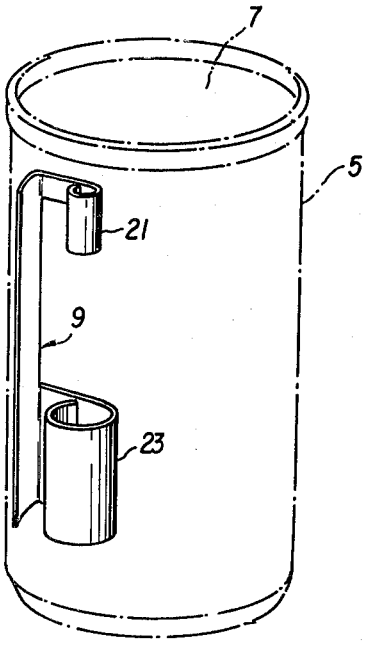
FIG. 3 illustrates a perspective view of the straw guide used to position and secure the straw within the can.

As illustrated in FIGS. 2 and 3, straw guide 9 has a top and a bottom straw retaining portions 21, 23 respectively. Both portions 21, 23 cooperate to keep the straw 1 in proper alignment with the drinking slot.

The cross section of the top straw retaining portion 21 is large enough to allow the narrow portion of the straw 2 to slide freely through it, yet small enough to block the passage of the top of bellows 3. Further, the cross section of the bottom straw retaining portion 23 is large enough to allow the bellows 3 of straw 1 to slide freely through it after the can is opened. These two design features result in a straw guide 9 which permits free linear movement of straw 1 along the longitudinal axis of straw guide 9 as the liquid beverage is drawn out of the can by the consumer. Thus, if the bellows 3 is made without flow paths 15 and the suction created by the consumer in drawing the beverage through the straw 1 draws the bottom end of bellows 3 against the bottom 19 of can 5, the consumer may simply pull the straw 1 a little further out of the drinking slot of the can 3 as he drinks it, thus obviating the problem.

Additionally, the straw retaining portions 21, 23 of the straw guide 9 may be made so that the distance x between the upper edge of the bottom straw retaining portion 21 and the lower edge of the top straw retaining portion 23 is less than the expanded length y of bellows 3. This design feature insures that the straw guide 9 will retain straw 1 in orthogonal relationship with can top 7 regardless of the longitudinal position of straw 1 within the guide 9.

Moreover, it should be noted that while only one form of straw biasing means has been specifically discussed, (i.e., the resilient bellows) the invention includes any other type of biasing means which could obviously be substituted therefore, such as a spring.

Having now specifically described the structure and operation of my inventive "sip can", I claim:

1. A tab top beverage can having a self-contained straw assembly, comprising:

(a) a beverage can having a top including a tab top opening assembly for forming a drinking slot;

(b) a drinking straw contained within said beverage can, said straw having a top end abutting the underside of said tab top opening assembly, and a bottom end having a biasing means including a compressible, integrally formed resilient bellows for biasing said top end against said underside of said tab top opening assembly and pushing said top end of said straw through said drinking slot when said tab top assembly is removed to open said can, and (c) an elongated straw guide means mounted on the inside of said beverage can in alignment with the longitudinal axis of said can for aligning said top end of said straw with said underside of said tab top opening assembly, said straw guide means including:

(i) a top retaining portion for slidably receiving and aligning said top end of said straw with said underside of said tab top opening assembly, said top retaining portion having a lower edge for obstructing slidable movement of said bellows of said straw through said top retaining portion, and (ii) a bottom retaining portion for slidably receiving said bellows of said straw and for securing said bellows within said can, wherein the longitudinal distance between said lower edge of said top retaining portion and the upper edge of said bottom retaining portion is less than the longitudinal length of said bellows when said bellows is expanded, whereby said straw guide means retains said straw in orthogonal disposition with said top of said beverage can at each position of said straw along the longitudinal axis of said straw guide means after said tab top assembly is removed to form a drinking slot.

2. The tab top beverage can of claim 1 wherein said straw guide means is integrally formed from a single section of sheet metal and tack welded on the inside wall of said beverage can in alignment with the longitudinal axis of said can.

3. The tab top beverage can of claim 1 wherein said bellows includes at least one flow path at its bottom edge.

* * * * *